US007017664B2

(12) United States Patent
Walker et al.

(10) Patent No.: US 7,017,664 B2
(45) Date of Patent: Mar. 28, 2006

(54) SINGLE TRIP HORIZONTAL GRAVEL PACK AND STIMULATION SYSTEM AND METHOD

(75) Inventors: David Joseph Walker, Lafayette, LA (US); Wade Rebardi, Lafayette, LA (US); Marvin Bryce Traweek, Houston, TX (US); Floyd Bishop, Humble, TX (US)

(73) Assignee: BJ Services Company, Houston, TX (US)

( * ) Notice: Subject to any disclaimer, the term of this patent is extended or adjusted under 35 U.S.C. 154(b) by 358 days.

(21) Appl. No.: 10/095,182

(22) Filed: Mar. 11, 2002

(65) Prior Publication Data

US 2003/0037925 A1 Feb. 27, 2003

Related U.S. Application Data

(60) Provisional application No. 60/314,689, filed on Aug. 24, 2001.

(51) Int. Cl.
*E21B 43/04* (2006.01)

(52) U.S. Cl. ..... 166/278; 166/61

(58) Field of Classification Search ..... 111/278, 111/51, 332.4

See application file for complete search history.

(56) References Cited

U.S. PATENT DOCUMENTS 3,741,300 A 6/1973 Wolf et al.
4,452,313 A 6/1984 McMahan
4,498,536 A 2/1985 Ross et al.
5,909,769 A 6/1999 Duhon et al.
6,148,915 A 11/2000 Mullen et al.
6,216,785 B1 * 4/2001 Achee, Jr. et al. ..... 166/278
6,227,298 B1 5/2001 Patel
6,352,119 B1 3/2002 Patel
6,571,875 B1 * 6/2003 Bissonnette et al. ..... 166/278
6,575,246 B1 6/2003 Bixenman et al.

OTHER PUBLICATIONS

OSCA, The Bottom-Up Gravel Pack System, TX10-6A & 6B, 1999, 2 pages, United States.
OSCA, Wash Down Type CompSet Non-Gravel Pack System, TX10-30, 1999, 1 page, United States.

* cited by examiner

*Primary Examiner*—William Neuder
(74) *Attorney, Agent, or Firm*—Locke Liddell & Sapp LLP

(57) ABSTRACT

A method for completing a well in a single trip, including: inserting a completion tool assembly into the well, the completion tool assembly having a gravel packing assembly and a service tool assembly slidably positioned substantially within an interior cavity in the gravel packing assembly; removably coupling the service tool assembly and the gravel packing assembly; plugging at a first location, whereby fluid is blocked from flowing through the interior channel; diverting fluid blocked by the plugging at the first location through a first fluid flow path to an exterior of the completion tool assembly; circulating a gravel pack slurry through the completion tool assembly; plugging at a second location, whereby fluid is blocked from flowing through the interior channel; diverting fluid blocked by the plugging at the second location through a second flow path that reenters the interior channel at a location distal of the first and second plugging locations; and circulating a filter cake stimulating fluid through the well completion assembly.

30 Claims, 19 Drawing Sheets

SINGLE TRIP HORIZONTAL GRAVEL PACK AND STIMULATION SYSTEM AND METHOD

REFERENCE TO PRIOR APPLICATION

This application claims the benefit of U.S. Provisional Application No. 60/314,689, filed Aug. 24, 2001.

TECHNICAL FIELD

This invention relates in general to the field of gravel packing and stimulation systems for mineral production wells, and more particularly, to an improved method and system for performing gravel packing and stimulation operations.

BACKGROUND

In an effort to extract natural resources such as oil and gas, it is becoming increasingly common to drill a vertical well, and to subsequently branch off that well and continue to drill horizontally for hundreds or even thousands of feet. The common method for drilling horizontally will be described more fully below, but generally includes the steps of forming a fluid impermeable filter cake surrounding the natural well bore while drilling at the production zone, removing drilling fluid from the downhole service tools (washdown), performing gravel packing operations, and then removing the downhole service tools from the well bore. A stimulation tool is then run back into the well, and the well stimulated with the appropriate chemicals to remove the filter cake so that production may begin. The above-described method requires two "trips" down into the well bore with different tools to accomplish gravel packing and well stimulation. Each trip into the well can take as much as a day, with the cost of a rig running anywhere from $50,000.00 to $250,000.00 per day. Accordingly, achieving both gravel packing and stimulation in a single trip can be substantially beneficial. Further, each additional trip into the well also increases the risk of fluid loss from the formation. Fluid loss in some cases may substantially reduce the ability of the well to effectively produce hydrocarbons. Therefore, there is a need for a system and method that simply and reliably performs gravel packing and stimulation operations in a single trip into the well.

SUMMARY

In accordance with the present disclosure, there is a system which enable gravel packing and stimulating a horizontal well on a single trip into the well. Where a horizontal well is packed with a filter cake during a drilling operation, the present invention is used to gravel pack proximate to the production zone and stimulate the production zone by removing the filter cake, all in a single trip.

According to one aspect of the invention, there is provided a method for completing a well comprising the steps of: inserting a completion tool assembly into the well, the completion tool assembly having a gravel packing assembly and a service tool assembly slidably positioned substantially within an interior cavity in the gravel packing assembly; removably coupling the service tool assembly and the gravel packing assembly; inserting a first plugging device into an interior channel within the service tool assembly to substantially block fluid from flowing through the interior channel past the first plugging device; diverting the fluid blocked by the first plugging device through a first fluid flow path to an exterior of the completion tool assembly; gravel packing the well with the completion tool assembly; inserting a second plugging device into the interior channel of the service tool assembly to substantially block fluid from flowing through the interior channel past the second plugging device; diverting the fluid blocked by the second plugging device through a second flow path that reenters the interior channel at a location distal of the first and second plugging devices; and stimulating the well with the well completion assembly.

According to a further aspect of the invention, there is provided a well completion tool assembly for gravel packing and stimulating a well comprising: a gravel packing assembly including a gravel packer; a service tool assembly slidably positioned substantially within an interior channel of the gravel packing assembly and capable of being removably coupled thereto, the service tool assembly including a cross-over tool having a cross-over tool aperture therein, an interior conduit between an annular bypass port into the interior channel located distal of the cross-over tool aperture and a exterior port to an exterior of the service tool assembly located proximal of the cross-over tool aperture, and an annular bypass closing mechanism for selectively opening and closing the annular bypass port.

According to still another aspect of the invention, there is provided a method for completing a well comprising the steps of: inserting into the well a completion tool assembly having a gravel packing assembly having a gravel packer, and a service tool assembly slidably positioned substantially within an interior cavity of the gravel packing assembly and having an interior channel therein; removably coupling the service tool assembly to the gravel packing assembly; setting the gravel packer; obstructing the interior channel with a first obstruction device; opening a first fluid flow path between the interior channel at a location proximal of the first obstruction device and an exterior of the well completion assembly at a location distal of the gravel packer; gravel packing the well with the completion tool assembly by pumping a slurry fluid into a proximal end of the interior channel and through the first fluid flow path; obstructing the first fluid flow path with a second obstruction device to prevent fluid flowing into the proximal end of the interior channel from flowing through the first fluid flow path; opening a second fluid flow path between the interior channel at a location proximal of the second obstruction device and the interior channel at a location distal of the first obstruction device, and stimulating the well with the completion tool assembly by pumping a stimulating fluid through into the proximal end of the interior channel and through the second fluid flow path.

According to another aspect of the invention, there is provided a method for completing a well in a single trip, the method comprising the steps of: inserting a completion tool assembly into the well, the completion tool assembly having a gravel packing assembly and a service tool assembly slidably positioned substantially within an interior cavity in the gravel packing assembly; removably coupling the service tool assembly and the gravel packing assembly; plugging at a first location, whereby fluid is blocked from flowing through the interior channel; diverting fluid blocked by the plugging at the first location through a first fluid flow path to an exterior of the completion tool assembly; circulating a gravel pack slurry through the completion tool assembly; plugging at a second location, whereby fluid is blocked from flowing through the interior channel; diverting fluid blocked by the plugging at the second location through a second flow path that reenters the interior channel at a location distal of the first and second plugging locations; and circulating a filter cake stimulating fluid through the well completion assembly.

BRIEF DESCRIPTION OF THE DRAWINGS

A more complete understanding of the present invention and advantages thereof may be acquired by referring to the following description taken in conjunction with the accompanying drawings, in which like reference numbers indicate like features, and wherein.

DETAILED DESCRIPTION

Preferred embodiments of the present invention are illustrated in the Figures, like numeral being used to refer to like and corresponding parts of the various drawings.

Figure 1:
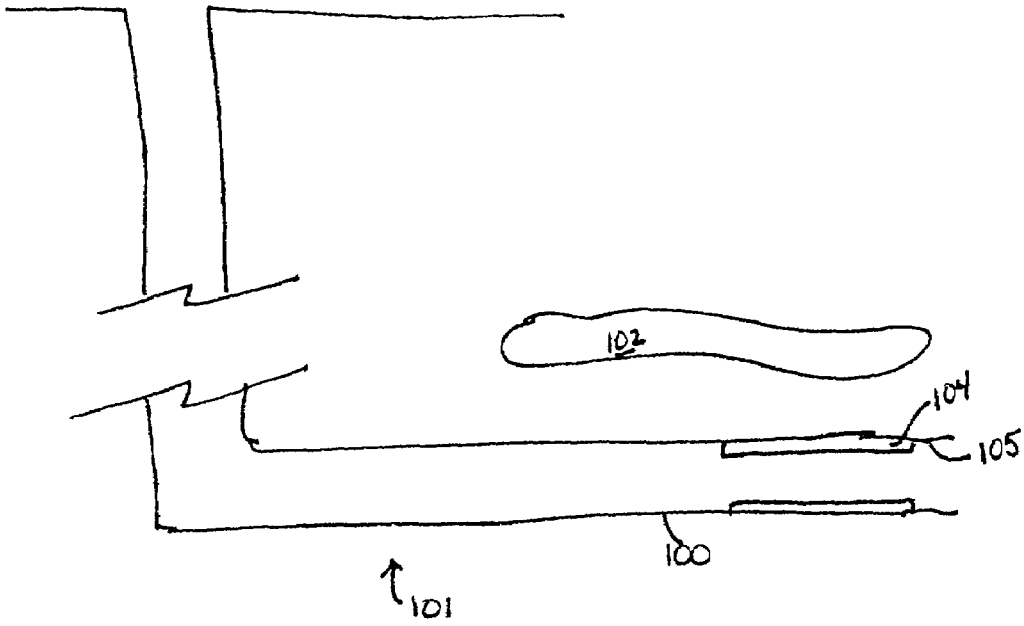
FIG. 1 illustrates a typical horizontal well having a filter cake covering a portion of the wellbore wall; (Prior Art).
Figure 2:
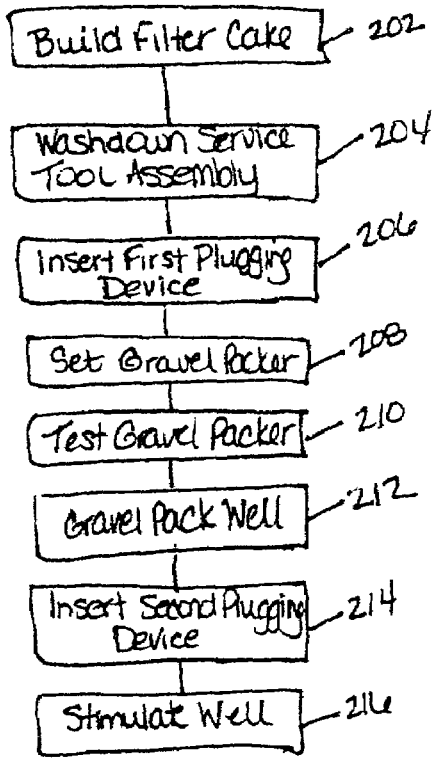
FIG. 2 is a flow chart illustrating steps for completing a well according to the present disclosure.

Referring now to FIG. 1, in horizontal wells 101 it is common practice not to form a casing in the well bore 100 along the portion of the horizontal wellbore through which oil or gas 102 is to be extracted. Instead, during drilling operations a "filter cake" 104 is deposited on an inner surface 105 of the wellbore. This filter cake is typically a calcium carbonate or some other saturated salt solution that is relatively fluid impermeable, and therefore, impermeable to the oil or gas in the surrounding formation. The filter cake is formed during drilling by pumping a slurry having particles suspended therein into the wellbore. The particles are deposited on the wellbore surface, eventually forming a barrier that is sufficiently impermeable to liquid. Systems and methods for depositing such a filter cake are well known in the art.

With the filter cake in place, the drilling equipment is removed from the well, and other tools are inserted into the well to pack the well with gravel. Once gravel packing is complete, the filter cake must be "stimulated" with the proper chemical solution to dissolve it to maximize production flow into the well. As indicated above, prior art systems and methods require removal of gravel packing tools and subsequent insertion of stimulation tools. According to the present disclosure, however, a single tool assembly can be lowered into the well to perform both gravel packing and stimulation in one trip.

A system and method for gravel packing and stimulating a well bore will now be described in greater detail with reference to FIGS. 1–8. According to one embodiment of the present disclosure, a completion tool assembly 301 including a gravel packing assembly 300 and a service tool assembly 330 is run into the well 101. The gravel packing assembly has an interior cavity 345 extending substantially along its entire length, and a substantial portion of the length of the service tool assembly is slidably positioned within the interior cavity of the gravel packing assembly. The service tool assembly can be retracted relative to the gravel packing assembly as is illustrated in FIGS. 3–8 and as will be described further below Although not explicitly shown in FIGS. 3–8, it is to be understood that a filter cake has already been deposited along the appropriate portion of the wellbore 101 (step 202 of FIG. 2).

The gravel packing assembly includes at a distal end 343 a production screen 306. The production screen may be a single screen, or preferably multiple production screen sections 306*a* interconnected by a suitable sealed joint 380, such as an inverted seal subassembly. When production begins, the production screen filters out sand and other elements of the formation from the oil or gas. The service tool assembly 330 includes a service string 332 coupled to a cross-over tool 334. A proximal end 336 of the service tool assembly includes a setting tool 382 that removably couples the service tool assembly to the gravel packer 320 of the gravel packing assembly at the proximal end 346 of the completion tool assembly. The proximal end of the service tool assembly is also coupled to a pipe string (not shown) that extends to the surface of the well for manipulating the service tool assembly.

Figure 3:
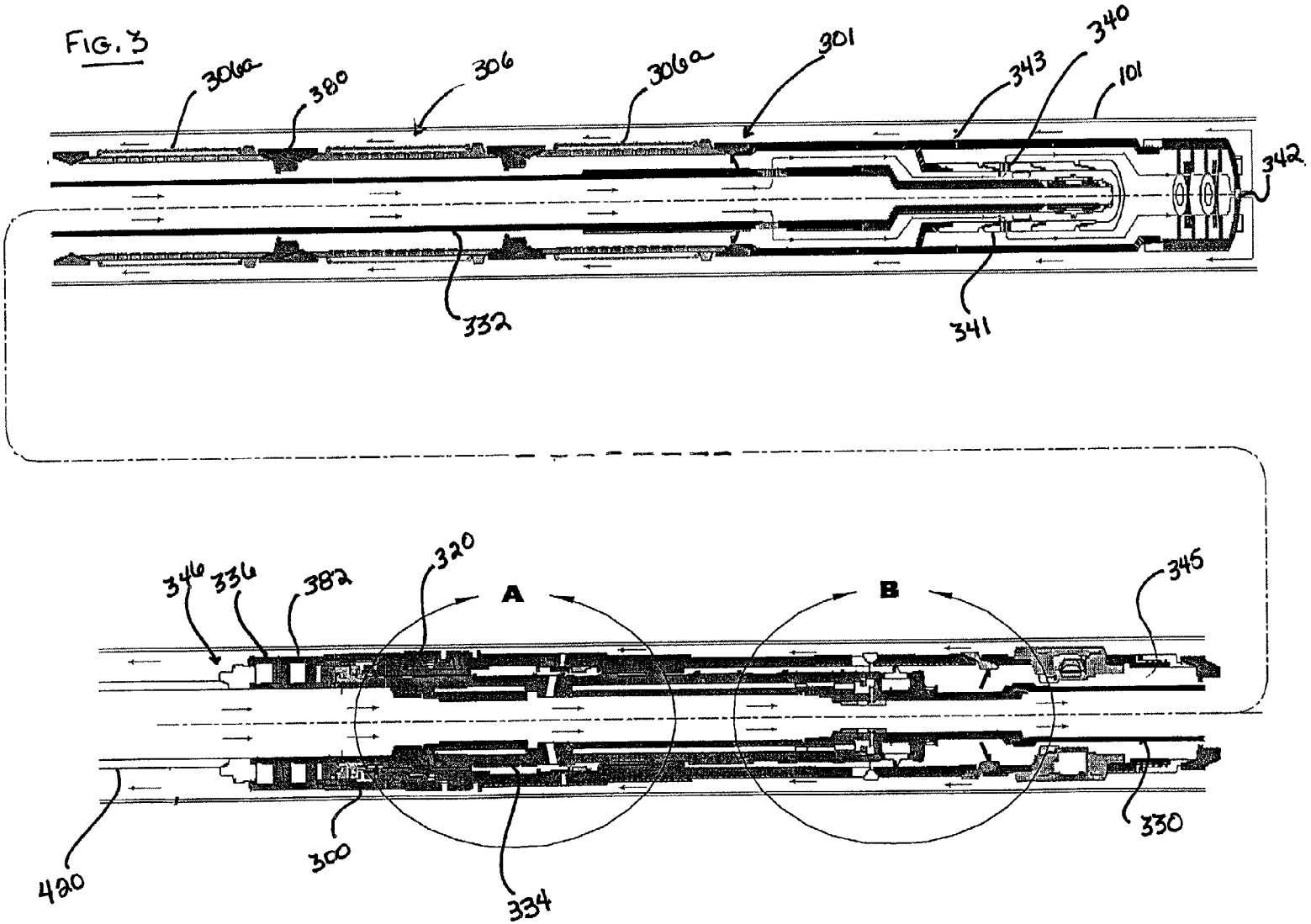
FIG. 3 illustrates a well completion tool assembly according to the present disclosure during washdown.
Figure 3A:
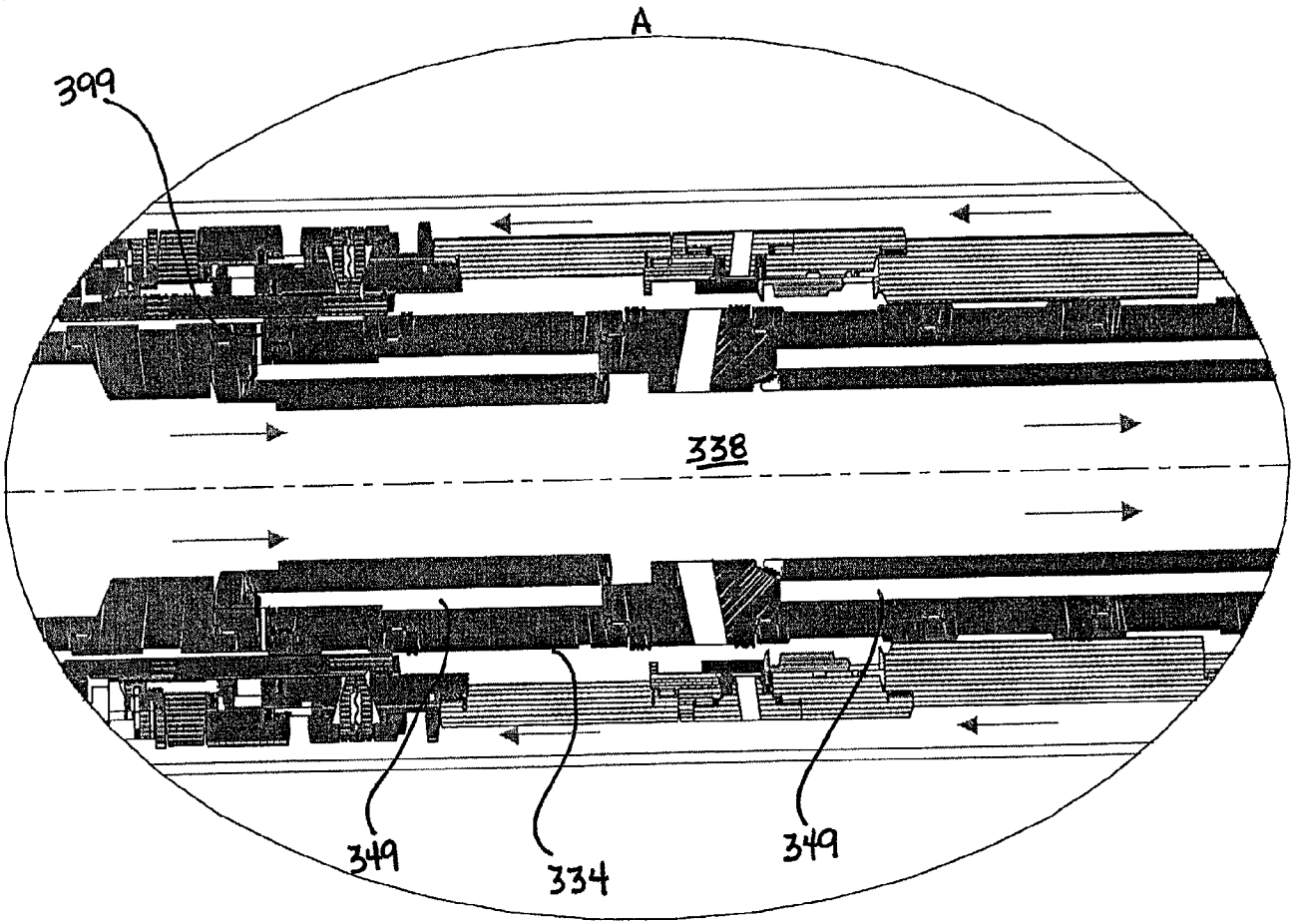
Figure 3B:
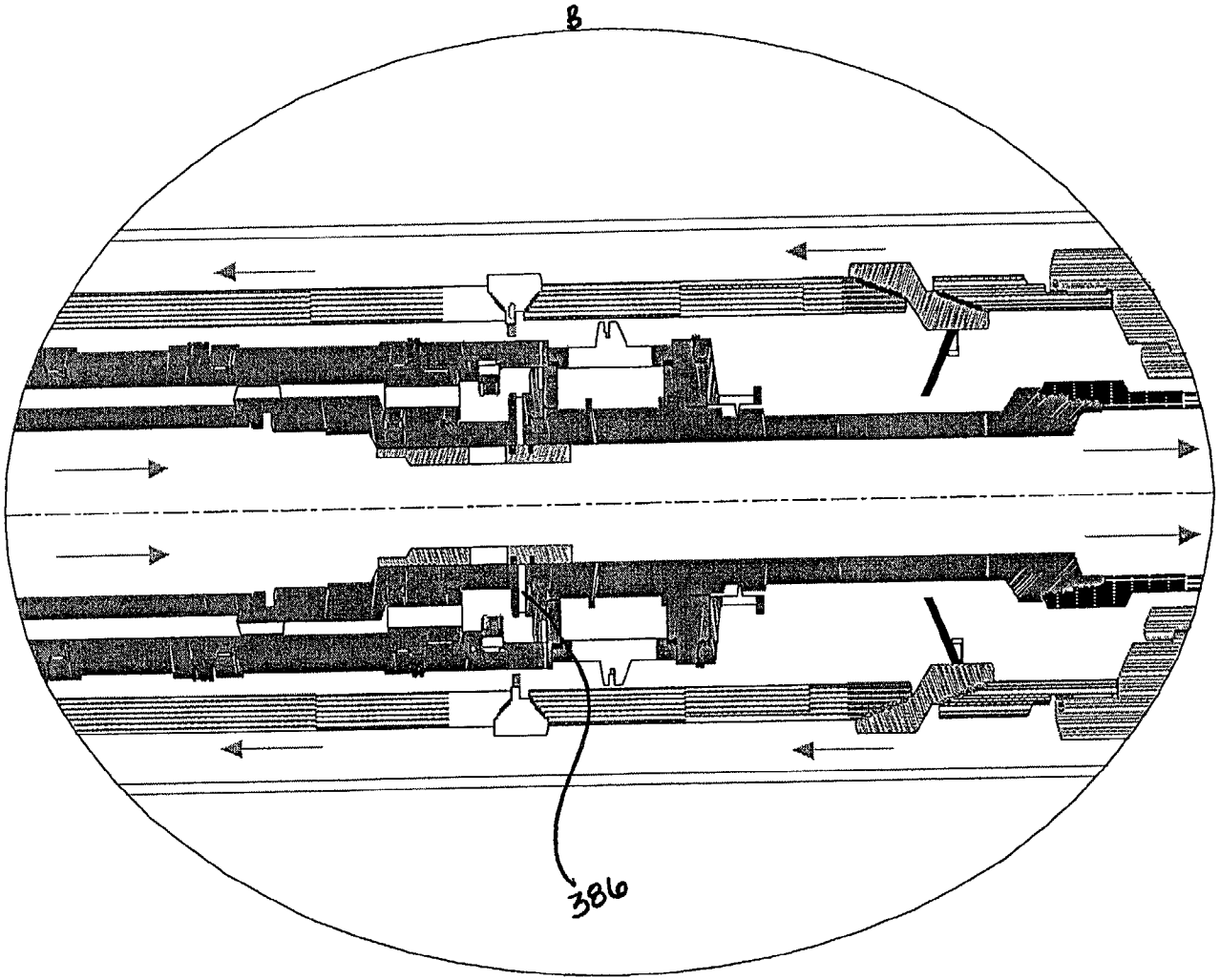

Cross-over tool 334 is of a type also well known in the art. Cross-over tool 334 includes at least one cross-over tool aperture 350 providing a fluid flow path between the interior channel 338 and an exterior of the cross-over tool. It also includes a separate internal conduits 349 that form a fluid flow path between an annular bypass port 386 that opens into the interior channel at a location distal of the cross-over tool apertures, and an exterior port 399 that opens to the exterior of the cross-over tool at a location proximal of the cross-over tool apertures. With the gravel packing assembly and service tool assembly in position within the wellbore as shown in FIG. 3, washdown operations (FIG. 2, step 204) are performed to remove any remaining drilling fluid or debris from the service tool assembly by pumping clean fluid therethrough. The fluid flow path during washdown is illustrated by the arrows in FIG. 3.

As shown, fluid flows in a substantially unobstructed path through an interior channel 338 in the service tool assembly. The fluid flows out into the well area through a distal aperture(s) 340 at the distal end 341 of the service tool assembly and a distal aperture(s) 342 at the distal end 343 of the gravel packing assembly and well completion tool, and back in the annular space between the completion tool assembly and the wellbore that, before setting of the gravel packer, is present along the entire length of the completion tool assembly. In this manner, the service string assembly and the outer annular area between the gravel pack and screen assembly and the casing/formation are flushed clean of any remaining drilling fluid or debris.

After washdown is complete, gravel packing operations begin, and the completion tool assembly described herein can simply and readily perform both operations. As indicated above, during washdown the interior channel 338 of the service tool assembly is substantially unobstructed. According to the present system and method, a first plugging device 322 is inserted into the interior channel 338 (step 206) to form an obstruction and divert the fluid path to enable setting of the gravel packer. The first plugging device may be made of any suitable material and of any suitable configuration such that it will substantially prevent fluid from flowing through the interior channel past the first plugging device. According to one embodiment, the first plugging device is a spherical steel ball. It is inserted into place by dropping it into the annulus of the tool string at the surface of the well, and will travel into the proper position within the service tool assembly by means of gravity and fluid flow. A primary ball seat 398 may also be positioned within the interior channel of the service tool assembly to help retain the first plugging device in the proper position.

Figure 4:
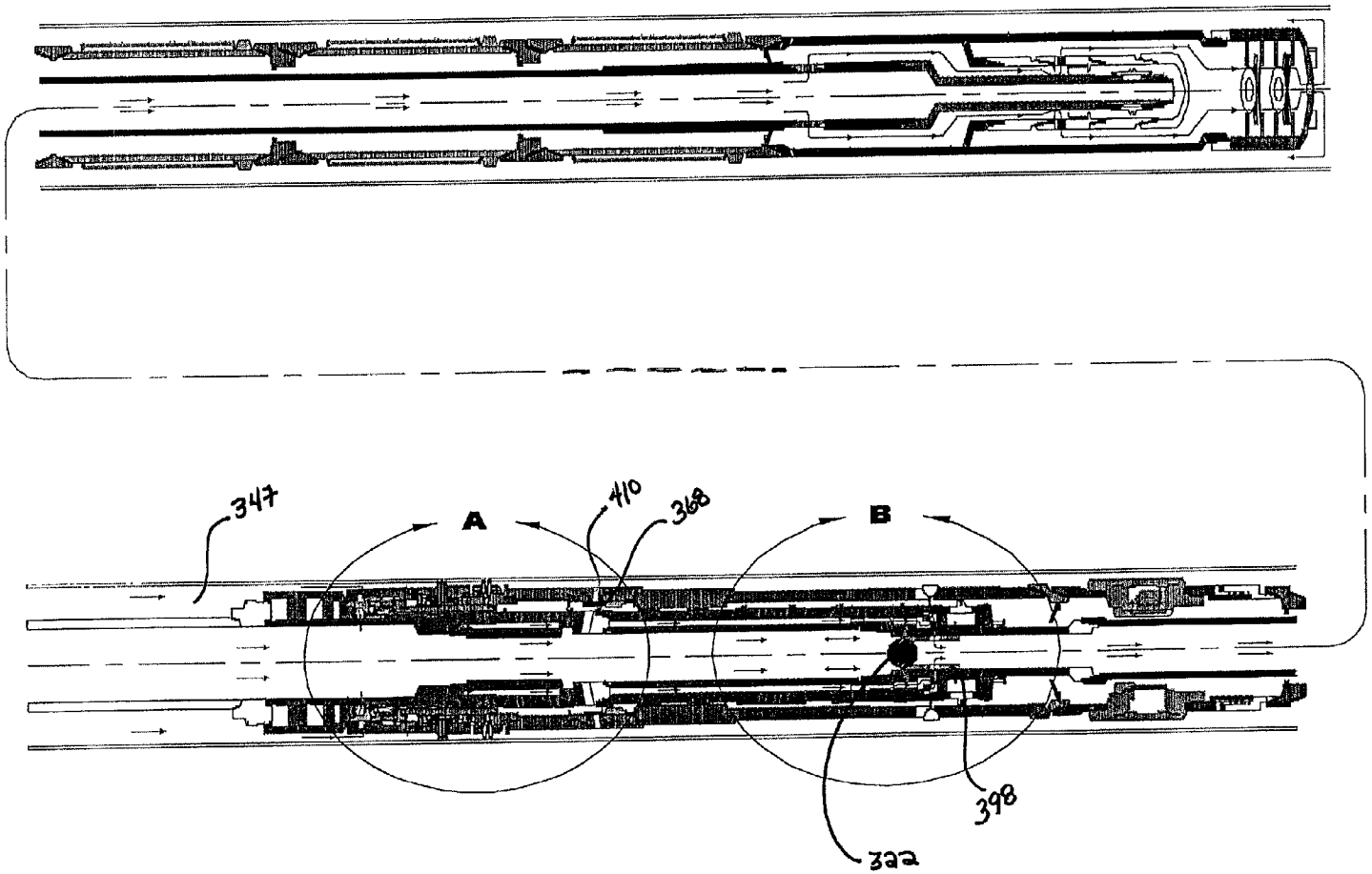
FIG. 4 illustrates a well completion tool assembly according to the present disclosure during setting of the gravel packer.
Figure 4A:
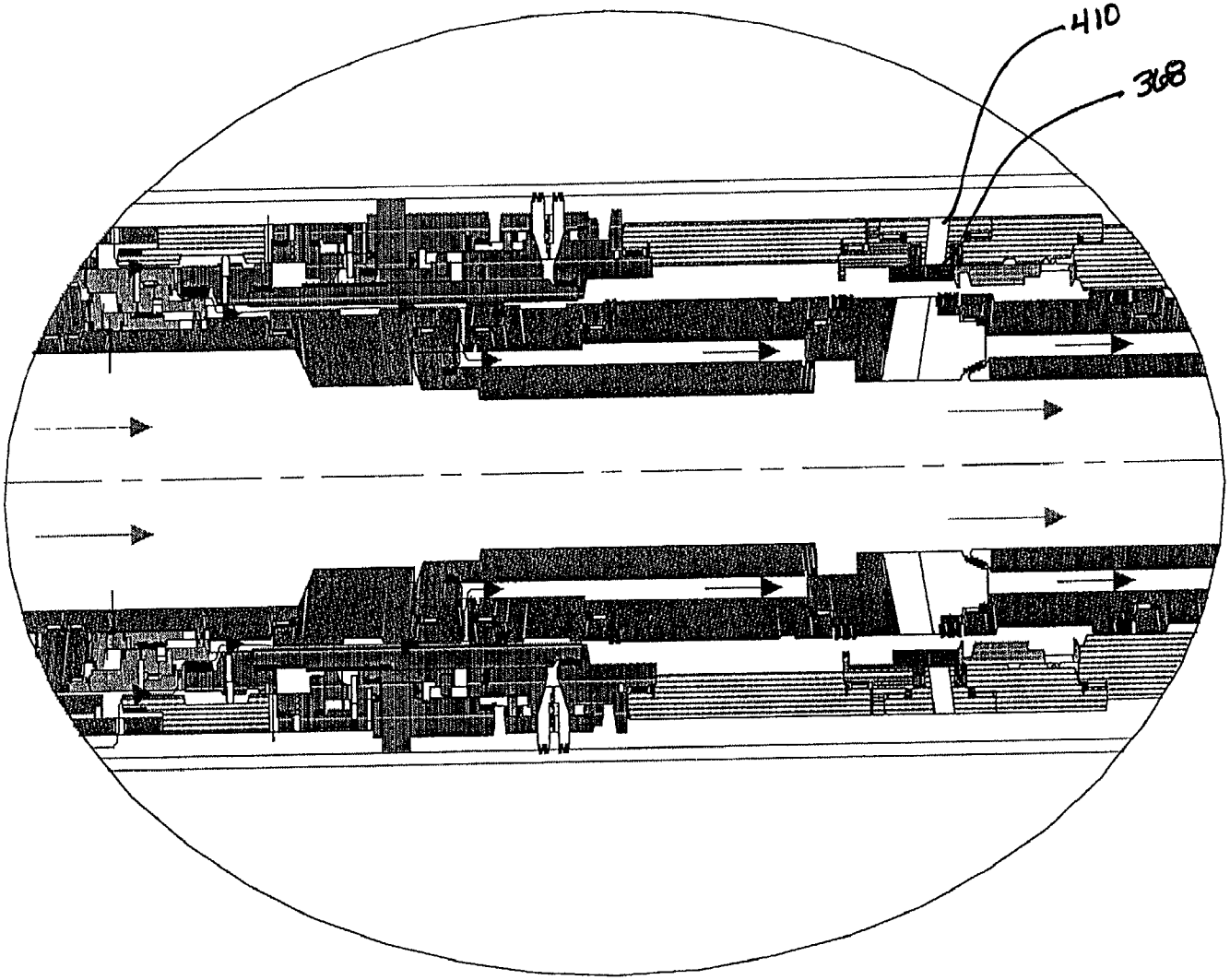
Figure 4B:
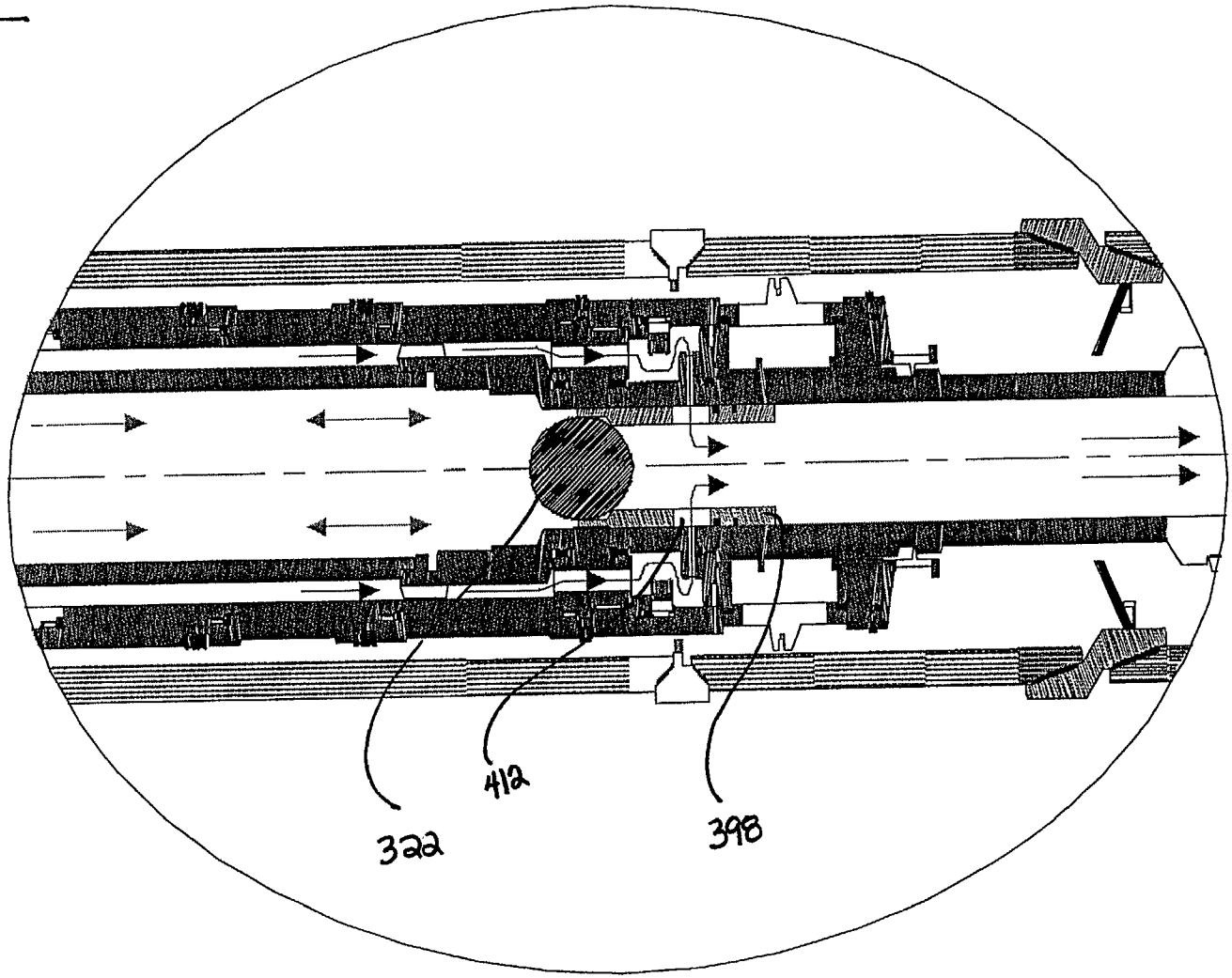

As shown in FIG. 4, the gravel packing assembly has at least one gravel packing aperture therein that, when the service tool assembly is removably coupled to the gravel packing assembly, is aligned with the cross-over tool aperture such that fluid may flow from the interior channel and through both apertures when unobstructed. A temporary closing sleeve 368, however, controls fluid flow through the gravel packing assembly apertures, and is in the closed position during setting of the gravel packer as shown in FIG. 4 (step 208). Thus, during setting, the first plugging device 322 obstructs fluid flow through the interior channel 338, and because the temporary closing sleeve is also closed, fluid pressure within the interior channel 338 of the service tool assembly builds up in the vicinity of the gravel packer sufficiently to force the gravel packer outwards against the wellbore, thereby setting the gravel packer in place against the wellbore. These techniques are well known in the art, as are standard cross-over tools.

The completion tool assembly of the present invention, however, is also able to maintain annular pressure on the well formation during setting of the gravel packer. The well completion tool assembly includes an annular bypass closing mechanism for selectively opening and closing the annular bypass port. According to one embodiment, this annular bypass closing mechanism includes a device positioned within the interior channel that is slidable relative to the interior channel between open and closed positions. The device is configured so that when in the closed position, it obstructs the annular bypass port, and when slid into the open position it is configured so as not to obstruct the annular bypass port. According to one embodiment, the device is also the primary ball seat. Seating of the first plugging device within the primary ball seat causes the primary ball seat to slide sufficiently so that an opening therein becomes substantially aligned with the annular bypass port 386 so as not to obstruct it. Thus, fluid may freely flow from a first annular space 347 proximal of the gravel packer through the internal cross-over tool channels and into the interior channel at a location distal of the first plugging device. Thus, annular pressure is maintained on the formation to help maintain its integrity prior to gravel pack operations.

Figure 5:
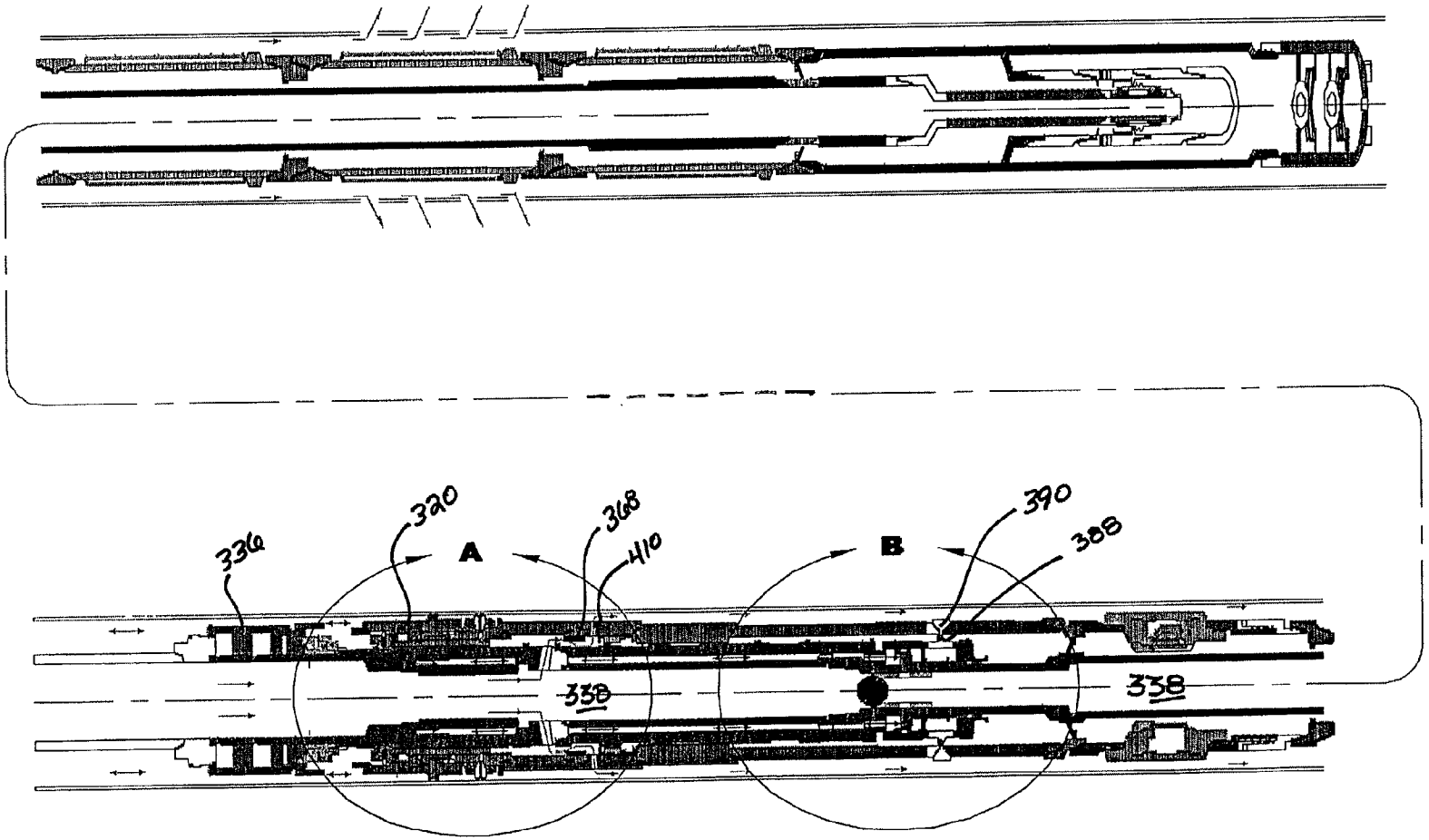
FIG. 5 illustrates a well completion tool assembly according to the present disclosure during testing of the gravel packer.
Figure 5A:
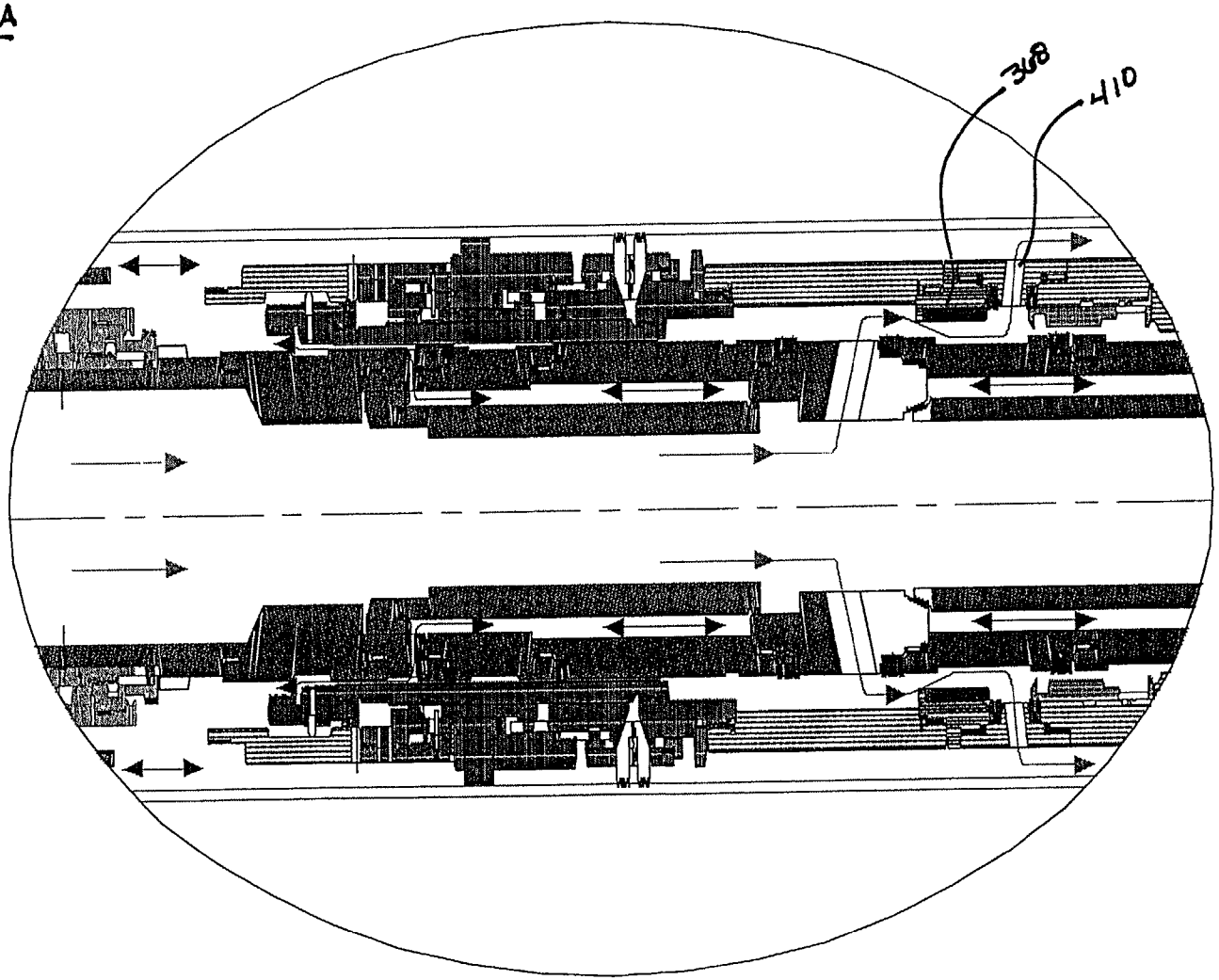
Figure 5B:
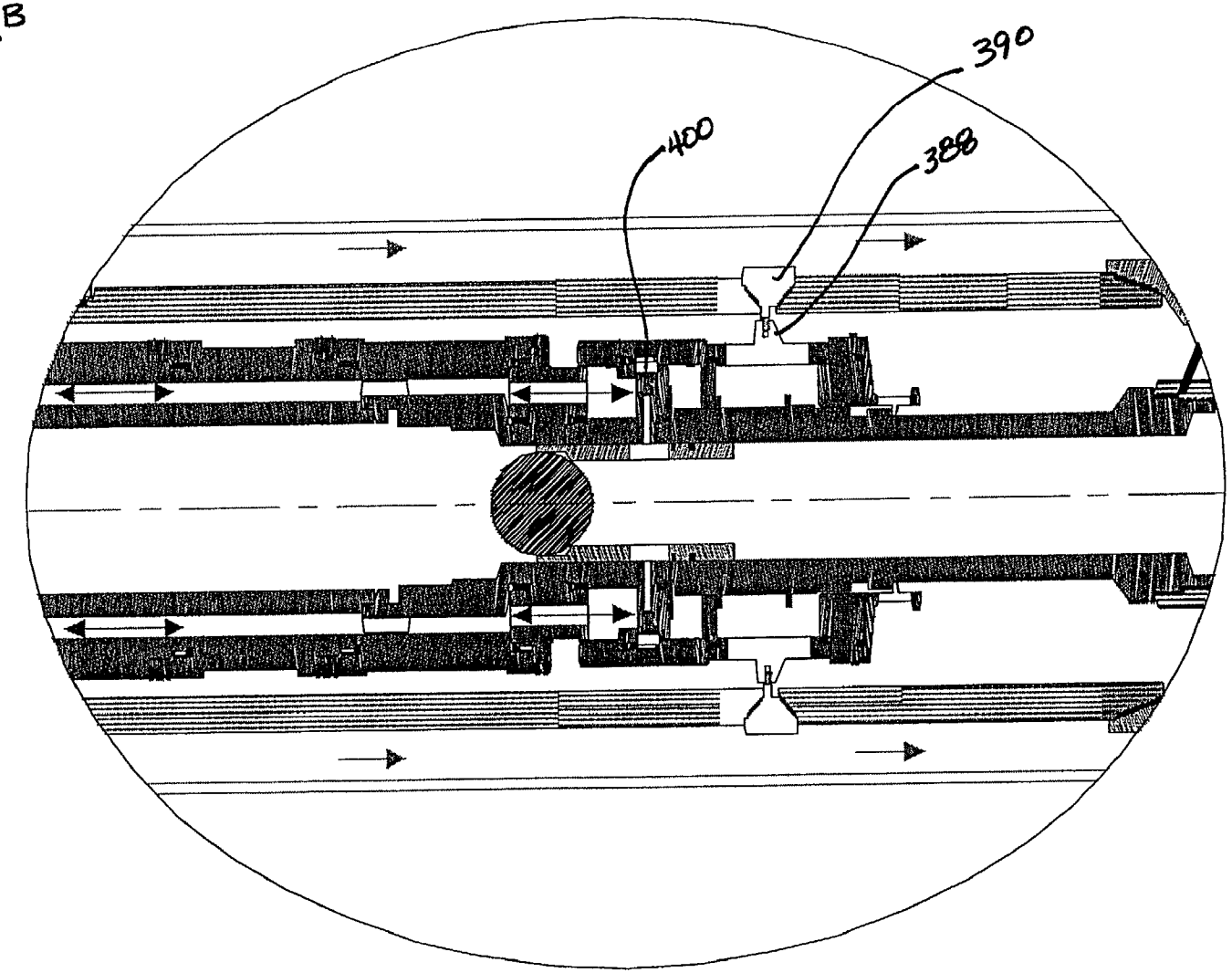

Once set, the gravel packer must be tested (step 210), and to test the packer the annular bypass port must once again be closed to isolate the annular fluid above the packer. As shown in FIG. 5, the proximal end 336 of the service tool assembly is uncoupled from the gravel packer 320, and the service tool assembly is partially retracted from within the gravel packing assembly. This movement of the service tool assembly relative to the gravel packing assembly opens the temporary closing sleeve 368, thereby allowing fluid flow between the interior channel 338 and the exterior of the gravel packing assembly. Further, this movement also causes a temporary interference collar 390 of the gravel packer assembly to engage a service tool isolation valve 388 that forms part of the service tool assembly. On further retraction of the service tool assembly, the service tool isolation valve stays substantially stationary relative to the gravel packing assembly, causing the annular bypass to once again be obstructed as shown in FIG. 5 by an interference member 400.

Figure 6:
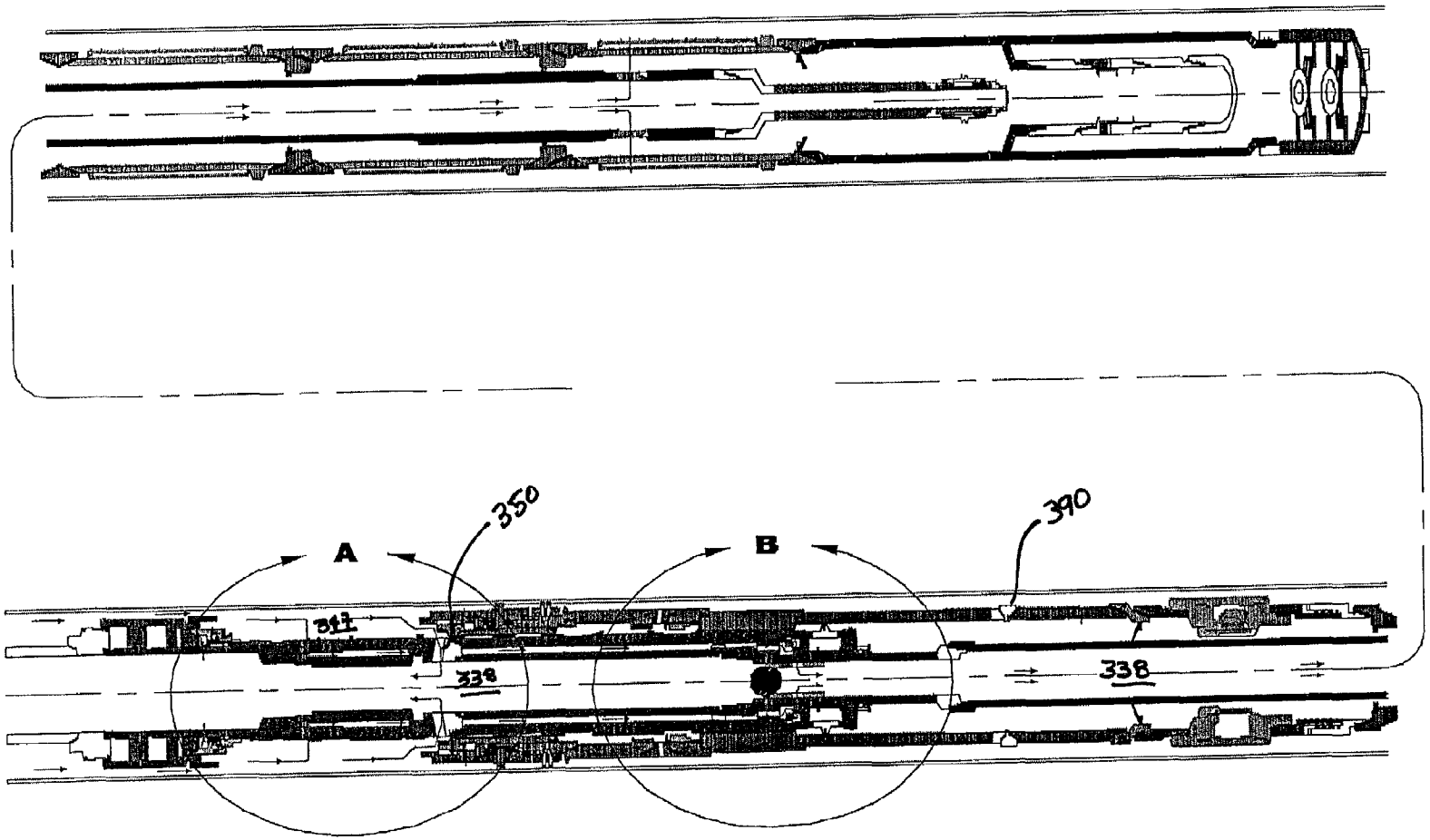
FIG. 6 illustrates a well completion tool assembly according to the present disclosure during reversing of the gravel packer.
Figure 6A:
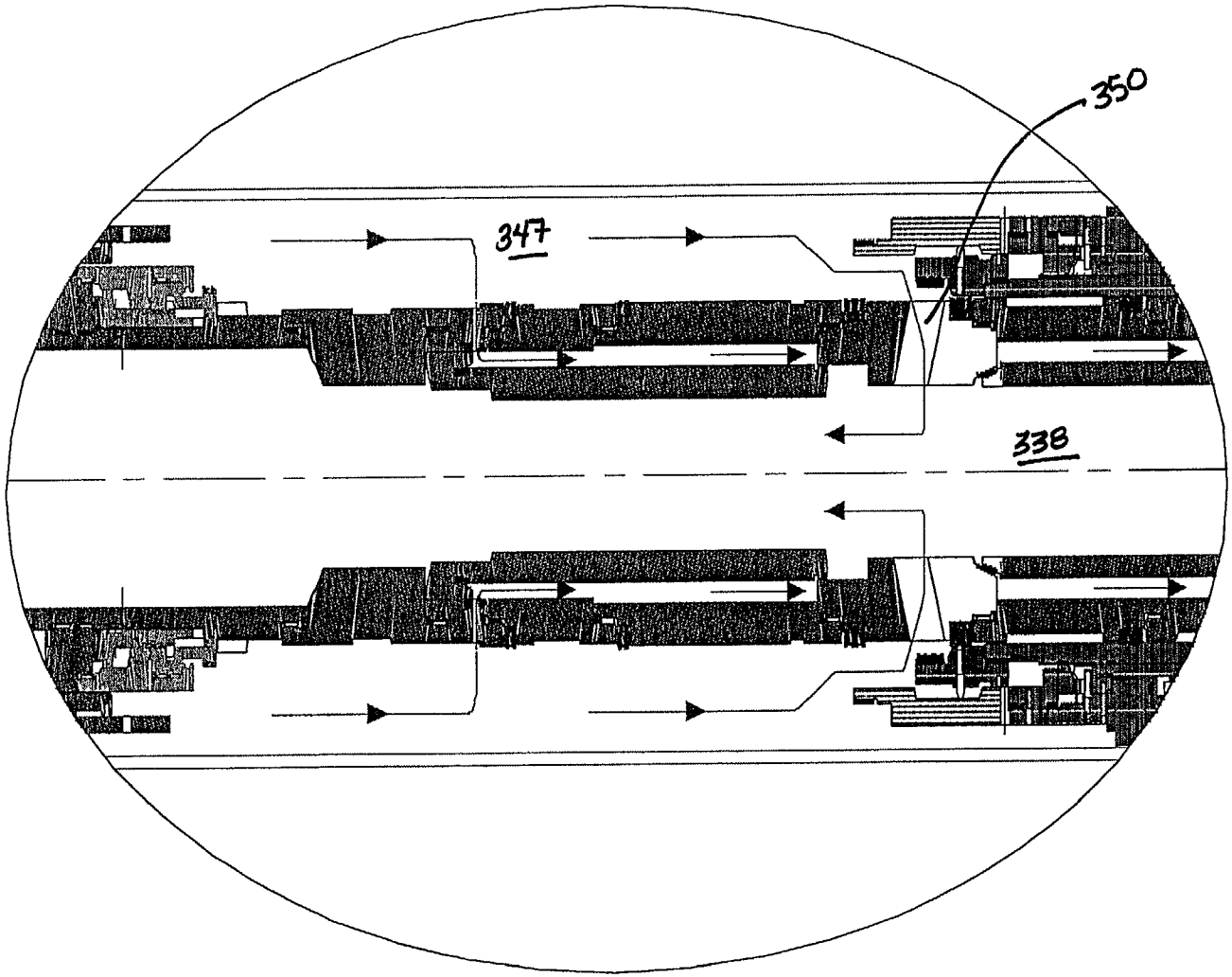
Figure 6B:
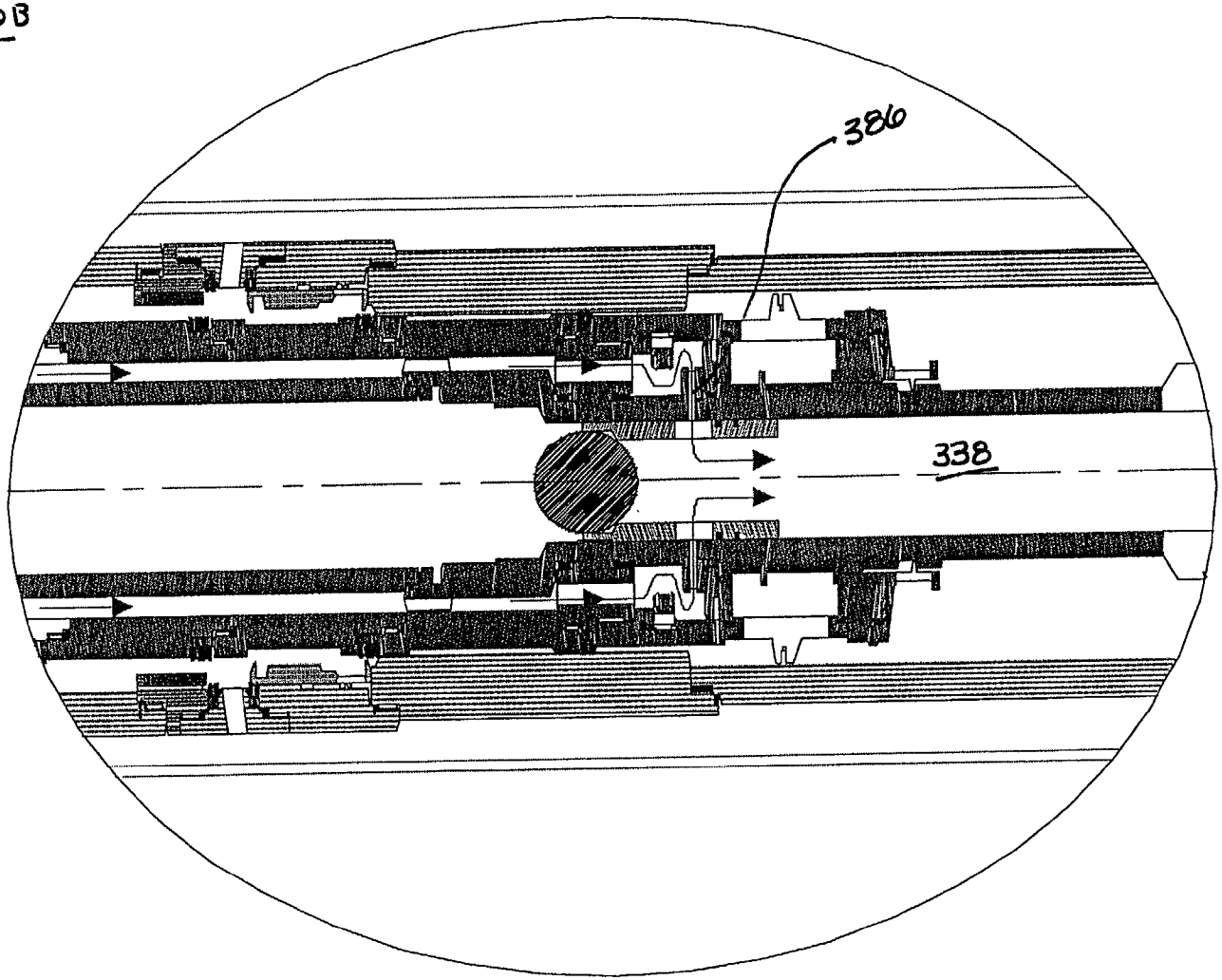

Following testing, the service tool is moved back downward removing the temporary interference collar to once again open the annular bypass 386 as shown in FIG. 6. Once this is accomplished, the service tool assembly is retracted relative to the gravel packing assembly to a point at which the cross-over tool apertures are positioned proximal of the gravel packer and form a flow path between the interior channel 338 and the first annular space. In this position fluid can be circulated at a point above the packer to avoid unnecessary exposure of the formation to such fluids. Thus, the well completion tool assembly according to the present disclosure is capable of selectively opening and closing the annular bypass port to advantageously maintain annular pressure on the formation and also to prevent pressure surges on the formation prior to and during gravel packing operations.

Figure 7:
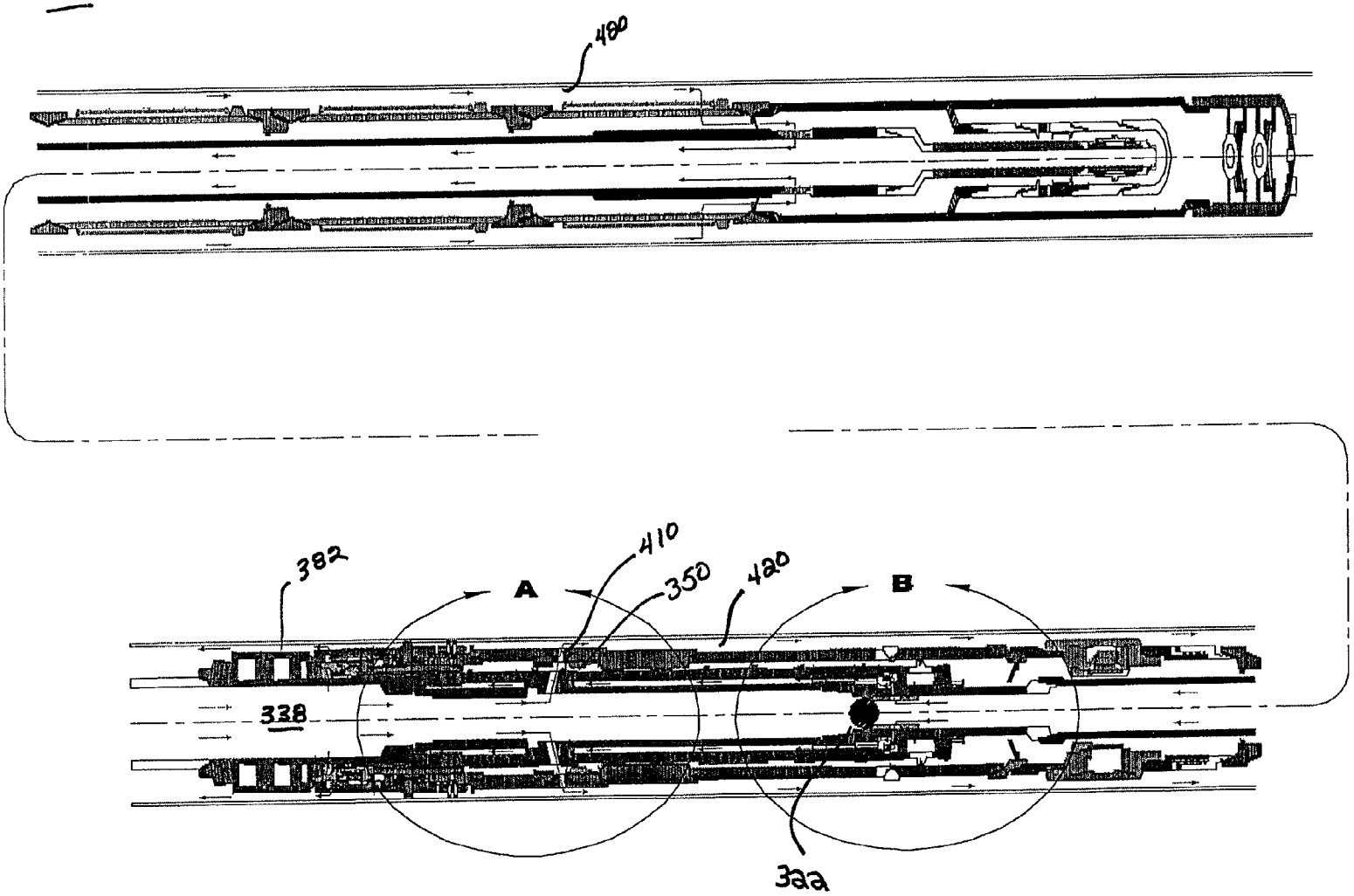
FIG. 7 illustrates a well completion tool assembly according to the present disclosure during gravel packing.
Figure 7A:
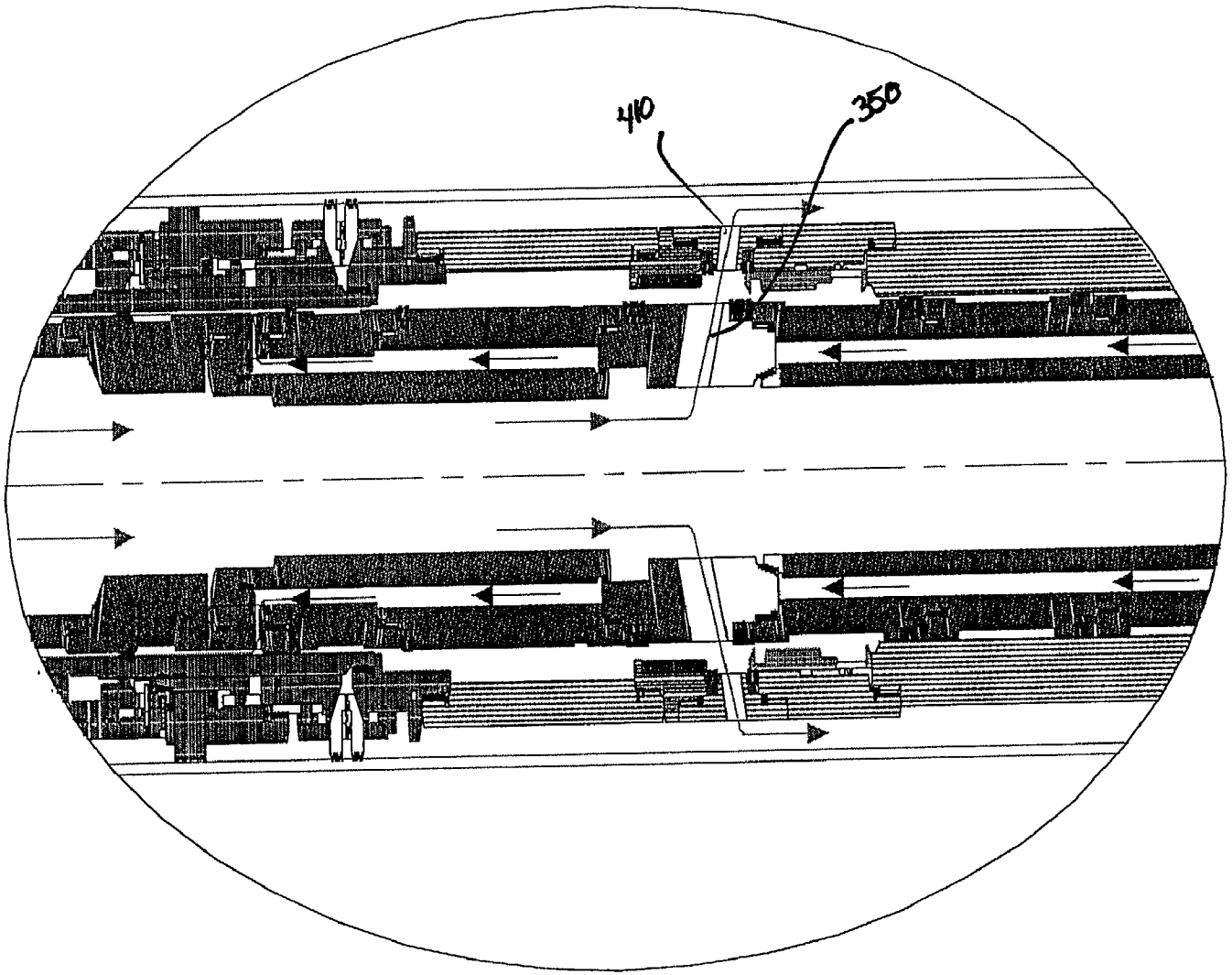
Figure 7B:
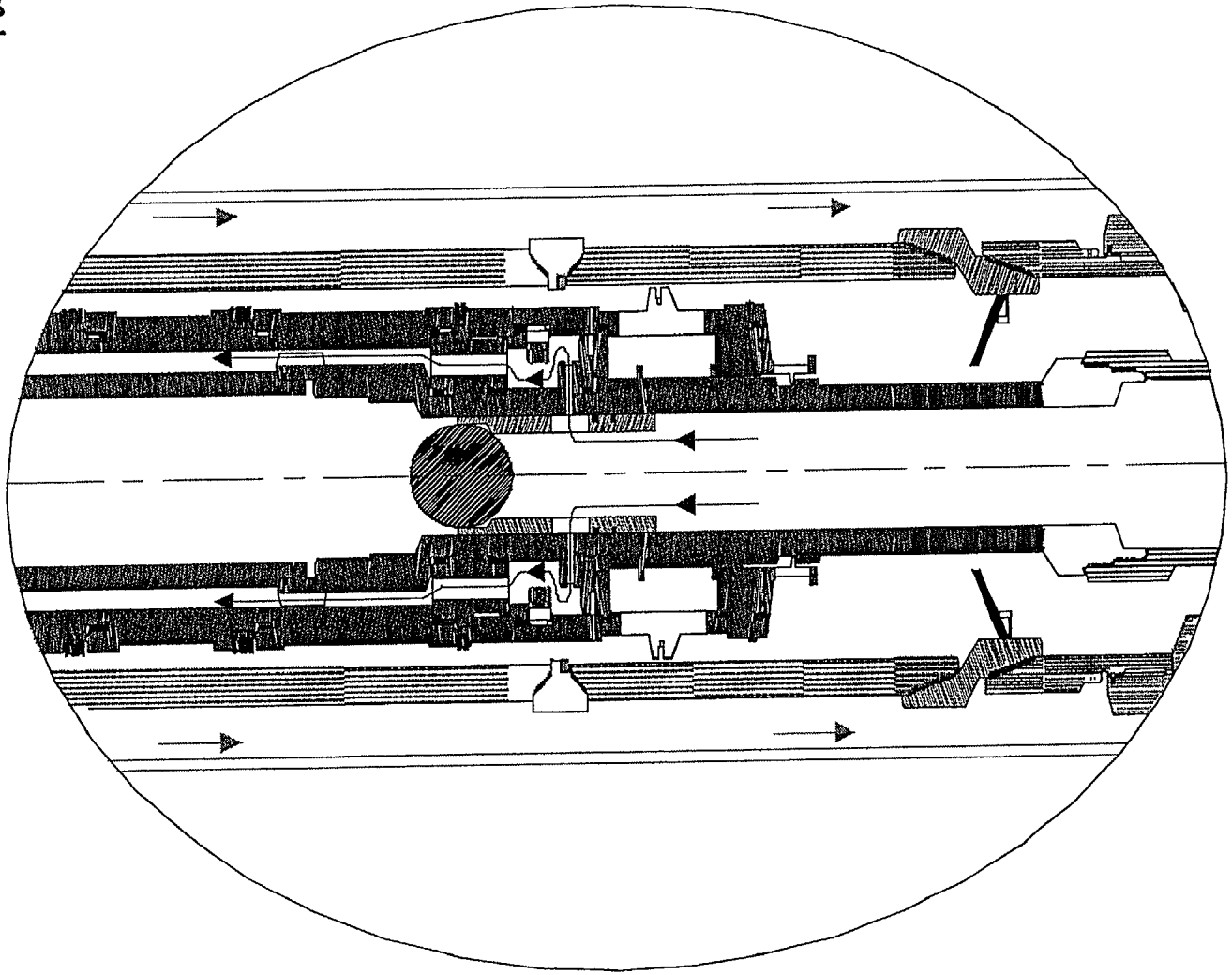

Subsequently, gravel packing is performed (step 212). As shown in FIG. 7, the service tool assembly is once again removable coupled to the gravel packing assembly by the setting tool 382. In this position, the cross-over tool apertures 350 again substantially line up with the now open gravel packing apertures 384. Thus, the fluid slurry used for gravel packing is pumped in through annular channel 338, and is diverted by the first plugging device 322 through the cross-over tool apertures 350 and gravel packing apertures 384, and out into the second annular space between the completion tool assembly and the wellbore, where it deposits sand in the production zone. Sand free fluid returns into the lower portion of the interior channel 338 through production screen 306, passes through the annular bypass port 386, internal conduit, and exterior port 399, and into the first annular space.

Once gravel packing is complete, the filter cake must be removed before oil or gas can be extracted from the surrounding formation. According to the present disclosure, the above-described completion tool assembly can also simply and easily perform well stimulation to remove the filter cake while remaining in the well.

Figure 8:
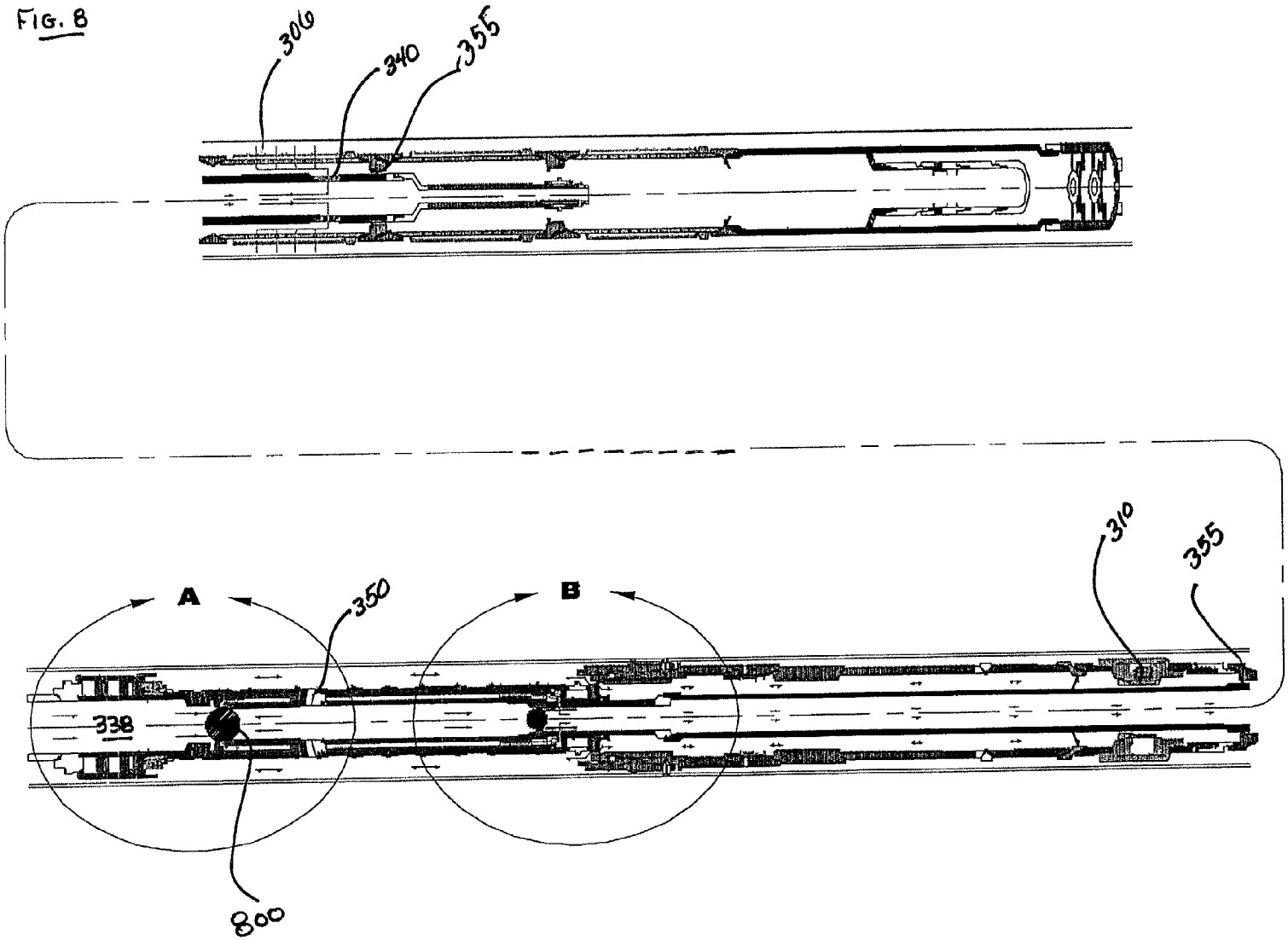
FIG. 8 illustrates a well completion tool assembly according to the present disclosure during stimulation of the well.
Figure 8A:
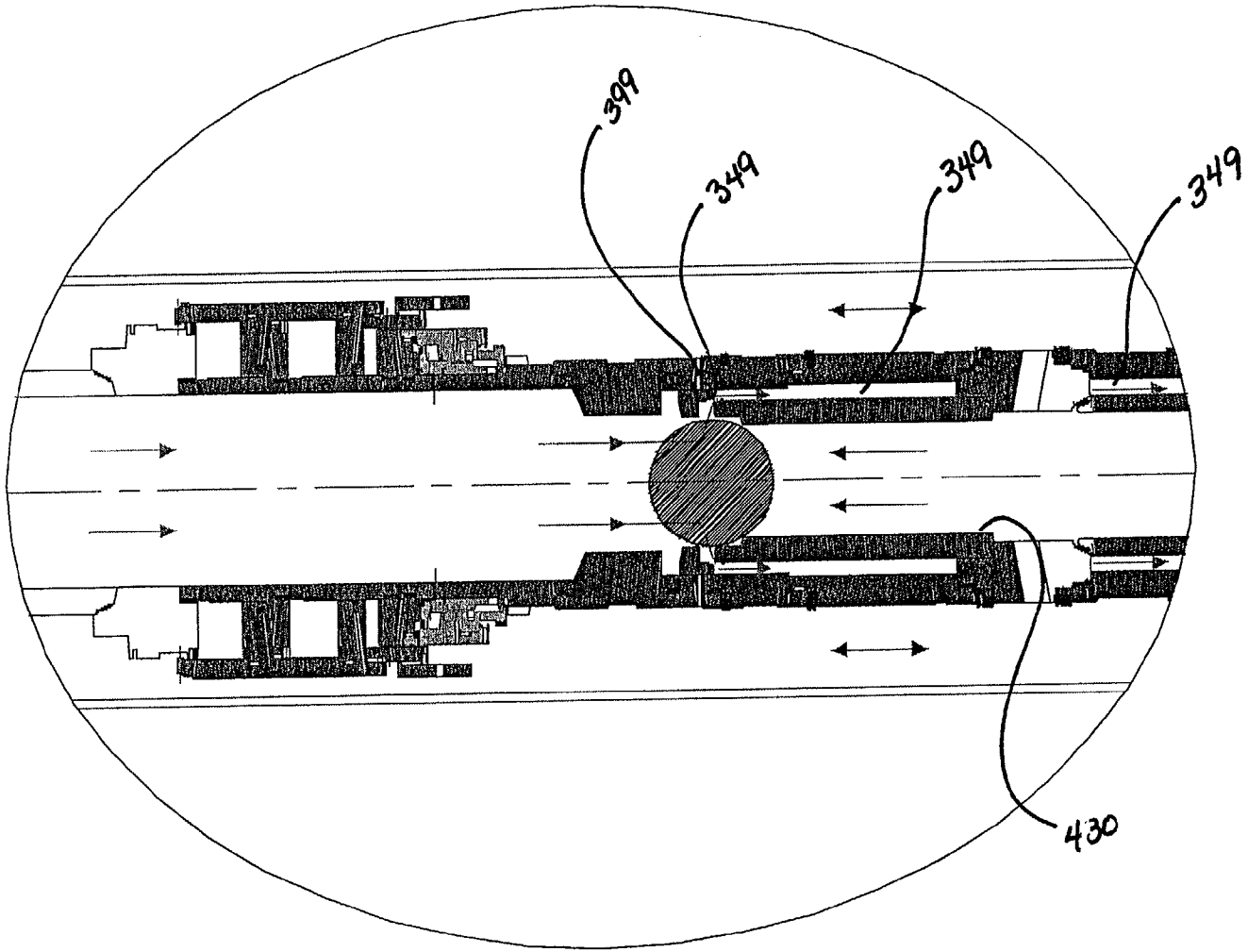
Figure 8B:
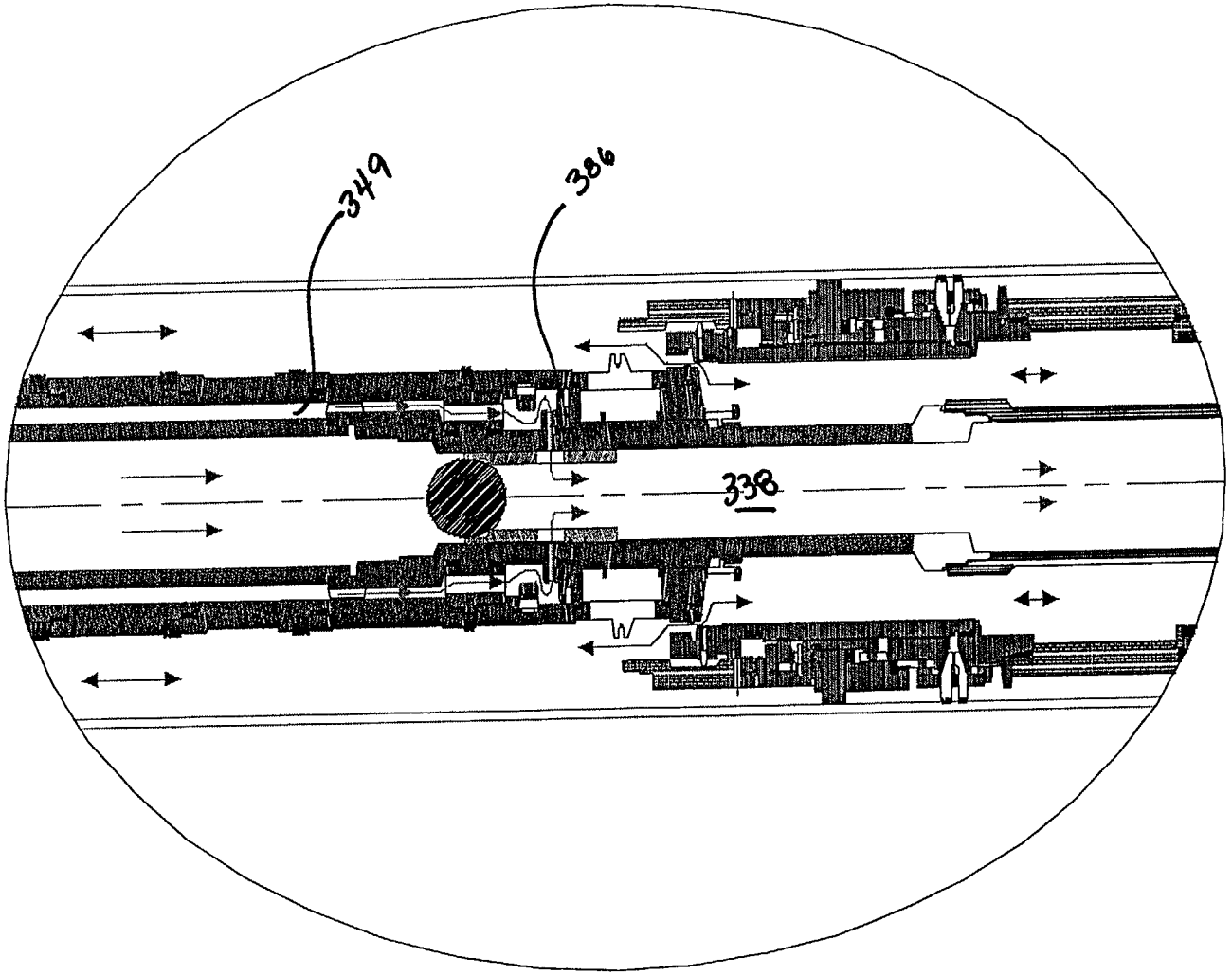

As shown in FIG. 8, a second plugging device 800 is inserted into the interior channel 338 of the service tool assembly to once again divert fluid flow (step 214). This second plugging device can be made of any suitable material, i.e., steel, and can be inserted into the service tool assembly in the same manner as described above for the first plugging device. The second plugging device, however, is of a diameter and configuration such that it forms a seal in a section of the interior channel of the service tool assembly that is above or proximal of the cross-over tool apertures 350, thereby isolating the cross-over tool apertures with plugging devices both above and below.

The interior conduit of the cross-over tool also extends between the annular bypass port and an interior port 349 into the interior channel at a location proximal of the cross-over tool aperture. This interior port is opened by a sleeve which is shifted downward by the second plugging device. This sleeve closes the annular bypass port and opens the interior port. Fluid pumped into the interior channel above the second plugging device is now diverted through the interior port 349, the interior conduit within the cross-over tool, the annular bypass port, and back into the interior channel 338 at a point below the first plugging device. Thus, fluid will once again flow into the interior channel at a point below or distal of the first plugging device, and the completion tool assembly can now be used to stimulate the well.

Stimulating fluid such as acids or solvents are pumped into the distal end of the interior chamber through the fluid path described above, where it exits the completion tool assembly through the distal apertures 340 in the service tool assembly and the production screen 306 of the gravel packing assembly. The stimulation fluid is diverted through the production screen by slick joints 355 that now seal off flow above and below the production screen. The stimulation fluid reacts with the filter cake on the surrounding wellbore to dissolve it. According to the present embodiment, the filter cake in the proximity of each screen element 306*a*, is dissolved one section at a time, optimally starting with the most distal screen section. This is done both to ensure that there is adequate pressure to force the stimulation fluid out into the filter cake, and also to ensure that the filter cake is dissolved in a controlled fashion to prevent leakage before production is ready to begin. The service tool assembly is simply retracted from within the gravel packing assembly to move from one section to the next.

Subsequently, the service tool assembly is removed from the well. As it is removed, flapper valve 310 closes behind it to prevent loss of oil or gas before the production tubing is in place and production is ready to begin.

Although the present invention has been described in detail, it should be understood that various changes, substitutions and alterations can be made hereto without departing from the spirit and scope of the invention as defined by the claims.

What is claimed is:

1. A method for completing a well in a single trip, comprising:

inserting a completion tool assembly into the well, the completion tool assembly comprising a gravel packing assembly and a service tool assembly slidably positioned substantially within the gravel packing assembly;

removably coupling the service tool assembly and the gravel packing assembly;

plugging at a first location, whereby fluid is blocked from flowing through an interior channel in the completion tool assembly;

opening an annular bypass port in the service tool assembly;

diverting fluid blocked by the plugging at the first location through a first fluid flow path to an exterior of said completion tool assembly;

circulating a gravel pack slurry into the completion tool assembly and along the first fluid flow path;

plugging at a second location, in the interior channel;

diverting fluid blocked by the plugging at the second location through the annular bypass and into the interior channel at a location distal of the first and second plugging locations; and circulating a filter cake stimulating fluid through the well completion assembly.

2. The method according to claim 1, wherein the plugging at a first location comprises:

inserting a first plugging device into the interior channel within the service tool assembly to substantially block fluid from flowing through the interior channel past the first plugging device;

wherein circulating a gravel pack slurry comprises gravel packing the well with the completion tool assembly;

wherein the plugging at a second location comprises inserting a second plugging device into the interior channel of the service tool assembly to substantially block fluid from flowing through the interior channel past the second plugging device; and wherein circulating a filter cake stimulating fluid comprises stimulating the well with the well completion assembly.

3. The method according to claim 2, wherein the gravel packing assembly further comprises a gravel packer and a gravel packing aperture, and wherein the service tool assembly further includes a cross-over tool comprising a cross-over tool aperture therein.

4. The method according to claim 3, wherein fluid flowing through the first fluid flow path flows through the cross-over tool aperture and the gravel packing aperture.

5. The method according to claim 4, further comprising inserting the first plugging device within the interior channel at a location distal of the cross-over tool aperture and proximal of the annular bypass port.

6. The method according to claim 5, wherein the annular bypass further comprises an internal conduit extending between the annular bypass port into the interior channel and located distal of the cross-over tool aperture, and an exterior port to a first annular space exterior of the service tool assembly and located proximal of the cross-over tool aperture.

7. The method according to claim 6, wherein the annular bypass further comprises an interior port to the internal channel located proximal of the cross-over tool aperture.

8. The method according to claim 7, further comprising inserting the second plugging device within the interior channel at a location proximal of the cross-over tool aperture and distal of the interior port.

9. The method according to claim 8, wherein prior to inserting the first plugging device the annular bypass port is closed, and fluid flowing into a proximal end of the interior channel flows substantially unobstructed through the interior channel and out through at least one distal aperture at a distal end of the service tool assembly.

10. The method according to claim 9, further comprising, prior to gravel packing:

opening the annular bypass port;

setting the gravel packer;

closing the annular bypass port;

testing the gravel packer; and opening the annular bypass port.

11. The method according to claim 10, wherein the gravel packing aperture is closed during setting of the gravel packer, and further comprising following setting the packer, opening the gravel packing aperture.

12. The method according to claim 11, wherein gravel packing comprises pumping a slurry fluid into the interior channel and along the first fluid flow path, wherein the fluid flows through the cross-over tool aperture and the gravel packing aperture into a second annular space between the completion tool assembly and the well located distal of the gravel packer.

13. The method according to claim 12, wherein stimulation further comprises pumping a stimulation fluid into the interior channel, through the annular bypass, and back into the internal channel, wherein the fluid flows through the interior port, the internal conduit, the annular bypass port, and into the interior channel of the service tool assembly at the location distal of the first and second plugging devices.

14. The method according to claim 13, further comprising, prior to diverting, opening the interior port and closing the external port.

15. The method according to claim 14, wherein inserting the second plugging device causes the interior port to open and the external port to close.

16. A well completion tool assembly for gravel packing and stimulating a well comprising:

a gravel packing assembly including a gravel packer;

a service tool assembly slidably positioned substantially within an interior channel of the gravel packing assembly and capable of being removably coupled thereto, the service tool assembly including a cross-over tool comprising a cross-over tool aperture therein, an interior conduit between an annular bypass port into the interior channel located distal of the cross-over tool aperture and a exterior port to an exterior of the service tool assembly located proximal of the cross-over tool aperture, and an annular bypass closing mechanism for selectively opening and closing the annular bypass port.

17. The well completion tool assembly according to claim 16, wherein the gravel packing assembly has a gravel packing assembly aperture therein in fluid communication with the cross-over tool aperture when the gravel packing assembly is removable coupled to the service tool assembly, and a temporary closing sleeve for selectively opening and closing the gravel packing assembly aperture.

18. The well completion tool assembly according to claim 17, further comprising a first plugging device capable of being received within an interior channel of the service tool assembly at a location distal of the cross-over tool aperture and proximal of the annular bypass port, wherein when inserted, the first plugging device substantially blocks fluid from flowing through the interior channel past the first plugging device.

19. The well completion tool assembly according to claim 18, wherein the internal conduit extends between the annular bypass port and an interior port into the interior channel located proximal of the cross-over tool aperture.

20. The well completion tool assembly according to claim 19, further comprising a second plugging device capable of being received within the interior channel of the service tool assembly at a location proximal of the cross-over tool aperture and distal of the interior port, wherein when inserted, the second plugging device substantially blocks fluid from flowing through the interior channel past the second plugging device.

21. The well completion tool assembly according to claim 20, wherein when the service tool assembly is removably coupled to the gravel packing assembly the exterior port is open, and wherein the annular bypass port closing mechanism includes a annular bypass closing sleeve positioned within the interior channel and slidable relative to the interior channel between a closed position in which the annular bypass port is obstructed and an open position in which the annular bypass port is not obstructed.

22. The well completion tool assembly according to claim 21, wherein the annular bypass closing sleeve is a primary ball seat for receiving the first plugging device when inserted into the interior channel, the primary ball seat sliding relative to the interior channel to open the annular bypass port when the first plugging device is inserted.

23. The well completion tool assembly according to claim 22, wherein the annular bypass closing mechanism further includes an interference member that obstructs the annular bypass port when the service tool assembly is retracted from within the gravel packing assembly to a predetermined first position.

24. The well completion tool assembly according to claim 23, wherein retraction of the service tool assembly to the predetermined first position causes the temporary closing sleeve to open the gravel packing aperture.

25. The well completion tool assembly according to claim 24, further comprising an interior port closing mechanism, wherein on receiving the second plugging device the interior port is closed.

26. The well completion tool assembly according to claim 25, wherein when the first plugging device is inserted and the temporary closing sleeve is opened, fluid flowing into a proximal end of the interior channel flows through the cross-over tool aperture and the gravel packing aperture to an exterior of the completion tool assembly at a location distal of the gravel packer.

27. The well completion tool assembly according to claim 26, wherein when the service tool assembly is retracted to the predetermined first position and the first and second plugging devices are inserted into the interior channel, fluid flowing into a proximal end of the interior channel flows through the interior port, the interior conduit and the annular bypass port and into the interior channel at a location distal of the first and second plugging devices.

28. A method for completing a well comprising:

inserting into the well a completion tool assembly comprising a gravel packing assembly comprising a gravel packer, and a service tool assembly slidably positioned substantially within an interior cavity of the gravel packing assembly and comprising an interior channel therein;

removably coupling the service tool assembly to the gravel packing assembly;

obstructing interior channel with a first obstruction device;

exposing a well formation adjacent the tool assembly to hydrostatic pressure;

setting the gravel packer;

opening a first fluid flow path between the interior channel at a location proximal of the first obstruction device and an exterior of the well completion assembly at a location distal of the gravel packer;

gravel packing the well with the completion tool assembly by pumping a slurry fluid into a proximal end of the interior channel and through the first fluid flow path;

obstructing the first fluid flow path with a second obstruction device to prevent fluid flowing into the proximal end of the interior channel from flowing through the first fluid flow path;

opening a second fluid flow path between the interior channel at a location proximal of the second obstruction device and the interior channel at a location distal of the first obstruction device, and stimulating the well with the completion tool assembly by pumping a stimulating fluid through into the proximal end of the interior channel and through the second fluid flow path.

29. A method of completing a well in a single trip comprising:

running into the well a completion tool assembly comprising a gravel packing assembly having a gravel packer and a gravel packing aperture, and a service tool assembly slidably positioned along an interior flow path in the completion tool assembly and removably coupled to the gravel packing assembly, the service tool assembly comprising a cross-over tool and a bypass conduit extending between an bypass port communicating with the interior channel and an exterior port communicating with a first annular space exterior of the service tool assembly, the bypass port located downhole of a cross-over tool aperture and the exterior port located uphole of the cross-over tool aperture;

blocking flow in the interior flow path at a first location downhole of the cross-over tool aperture to substantially block fluid from flowing through the interior flow path past the first plug;

opening the bypass port;

setting the gravel packer by pressurizing the interior flow path uphole of the first plug while maintaining annulus pressure uphole of the packer on the formation through the bypass conduit;

opening a first fluid flow path to the exterior of the completion tool assembly comprising the interior flow path uphole of the first plug, the cross-over tool aperture and the gravel packing aperture;

circulating a gravel pack slurry through the first flow path and returning fluid through the bypass conduit to the annulus uphole of the gravel packer;

blocking flow at a second location in the interior flow path uphole from the first blocking; and diverting interior flow blocked by the second plug through the bypass conduit and bypass port and back into the interior flow path downhole of the first and second plugs.

30. A well completion tool assembly comprising:

a gravel packing assembly comprising a gravel packer, a gravel packing aperture and a temporary closing sleeve for selectively opening and closing the gravel packing aperture;

a service tool assembly slidably positioned substantially within the gravel packing assembly such that the gravel packing aperture is substantially aligned with the cross-over tool aperture when the service tool assembly is removable coupled to the gravel packing assembly;

the service tool assembly comprising:

a cross-over tool having a cross-over tool aperture;

a circulation port having communication into an interior flow path and the port located downhole of the cross-over tool aperture an internal conduit extending between the circulation port and an interior port located uphole of the cross-over tool aperture;

a first mechanism for opening the circulation port to the interior flow path comprising a sleeve located in the interior flow path and having a primary seal seat, the opening mechanism slidable relative to the circulation port; and a second mechanism for selectively closing and opening the circulation port when service tool assembly is moved relative to the gravel packing assembly;

a first plug adapted to engage the primary seat and block fluid from flowing along the interior flow path past the first plug and adapted to slide the first opening mechanism to its opened condition;

a second plug adapted to engage another seat with the interior flow path at a location uphole of first plug to block fluid from flowing along the interior flow path past the second plug and adapted to close the interior port.

* * * * *